US007055572B2

(12) United States Patent
Nien et al.

(10) Patent No.: US 7,055,572 B2
(45) Date of Patent: Jun. 6, 2006

(54) WINDOW BLIND HAVING FABRIC SLATS

(75) Inventors: Ming Nien, Changhua Hsien (TW); Hermes Huang, Chang-Hwa Hsien (TW)

(73) Assignees: Nien Made Enterprise Co., Ltd., Taichung (TW); Yuan Peing Garment Co., Ltd., Chang-Hwa Hsien (TW)

( * ) Notice: Subject to any disclaimer, the term of this patent is extended or adjusted under 35 U.S.C. 154(b) by 0 days.

(21) Appl. No.: 10/901,100

(22) Filed: Jul. 29, 2004

(65) Prior Publication Data

US 2005/0199351 A1 Sep. 15, 2005

(30) Foreign Application Priority Data

Mar. 12, 2004 (TW) ..... 93203863 U

(51) Int. Cl.
*E06B 9/384* (2006.01)

(52) U.S. Cl. ..... 160/178.3; 139/384 A

(58) Field of Classification Search ..... 160/178.3 R, 160/178.1 R, 168.1 R, 236, 178.3; 139/384 A
See application file for complete search history.

(56) References Cited

U.S. PATENT DOCUMENTS 2,187,121 A * 1/1940 Graves ..... 160/236
2,275,273 A * 3/1942 Taylor ..... 66/170
2,304,534 A * 12/1942 Burns ..... 160/173 R
3,256,928 A * 6/1966 Hensel ..... 160/178.3
3,916,973 A * 11/1975 Schuppler et al. ..... 160/178.3
5,829,506 A * 11/1998 Zorbas ..... 160/236
6,854,504 B1 * 2/2005 Nien ..... 160/176.1 R
2004/0103994 A1 6/2004 Nien

FOREIGN PATENT DOCUMENTS

TW 547056 8/2003

* cited by examiner

*Primary Examiner*—David Purol
(74) *Attorney, Agent, or Firm*—Birch, Stewart, Kolasch & Birch, LLP

(57) ABSTRACT

A window blind includes a headrail, a bottom rail and a plurality of fabric slats arranged in parallel between the headrail and the bottom rail. Each fabric slat has two stiff support rods disposed at the two opposite long sides thereof. A plurality of ladder tapes are symmetrically connected between the headrail and the bottom rail and located respectively at the two opposite long sides of the fabric slats. Each ladder tape is formed of a plurality of strands by weaving and has a plurality of through holes in the netting structure thereof for the insertion of the support rods of the fabric slats so as to join the fabric slats to the ladder tapes between the headrail and the bottom rail at different elevations.

6 Claims, 8 Drawing Sheets

WINDOW BLIND HAVING FABRIC SLATS

This Nonprovisional application claims priority under 35 U.S.C. § 119(a) on patent application Ser. No(s). 093203863 filed in Taiwan, Republic of China on Mar. 12, 2004, the entire contents of which are hereby incorporated by reference.

BACKGROUND OF THE INVENTION

1. Field of the Invention

The present invention relates to a window blind and more particularly, to a window blind having fabric slats.

2. Description of the Related Art

A conventional window blind having fabric slats, as shown in Taiwan Patent Publication No. 547056, which is the corresponding patent application of U.S. Patent Publication No. 2004/0103994, is known comprising a headrail fixedly fastened to the top side of a window, a bottom rail suspended below the headrail, a plurality of fabric slats horizontally arranged in parallel between the headrail and the bottom rail, each fabric slat having two opposite long sides respectively supported with a stiff support rod with at least one coupling portion, and a plurality of ladder tapes connected between the headrail and the bottom rail, each ladder tape having a plurality of vertically spaced retaining devices respectively fastened to the coupling portions of the support rods of the fabric slats.

The retaining devices can be loops, C-clamps, retaining rods. When loops are used, the user must stretch open each soft loop with one hand and then insert the support rod through the soft loop. This complicated installation procedure needs much time and labor to achieve. When C-clamps and retaining rods are selected, special molds must be used to make the designed C-clamps and retaining rods, resulting in a high manufacturing cost and lowering market competition power.

SUMMARY OF THE INVENTION

The present invention has been accomplished under the circumstances in view. It is the primary objective of the present invention to provide a window blind having fabric slats, which employs a weaving method to make ladder tapes for the insertion of support rods to join fabric slats.

To achieve this objective of the present invention, the window blind comprises a headrail, a bottom rail and a plurality of fabric slats arranged in parallel between the headrail and the bottom rail. Each fabric slat has two stiff support rods disposed at the two opposite long sides thereof. A plurality of ladder tapes are symmetrically connected between the headrail and the bottom rail and located respectively at the two opposite long sides of the fabric slats. Each ladder tape is formed of a plurality of strands by weaving and has a plurality of through holes in the netting structure thereof for the insertion of the support rods of the fabric slats so as to join the fabric slats to the ladder tapes between the headrail and the bottom rail at different elevations.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
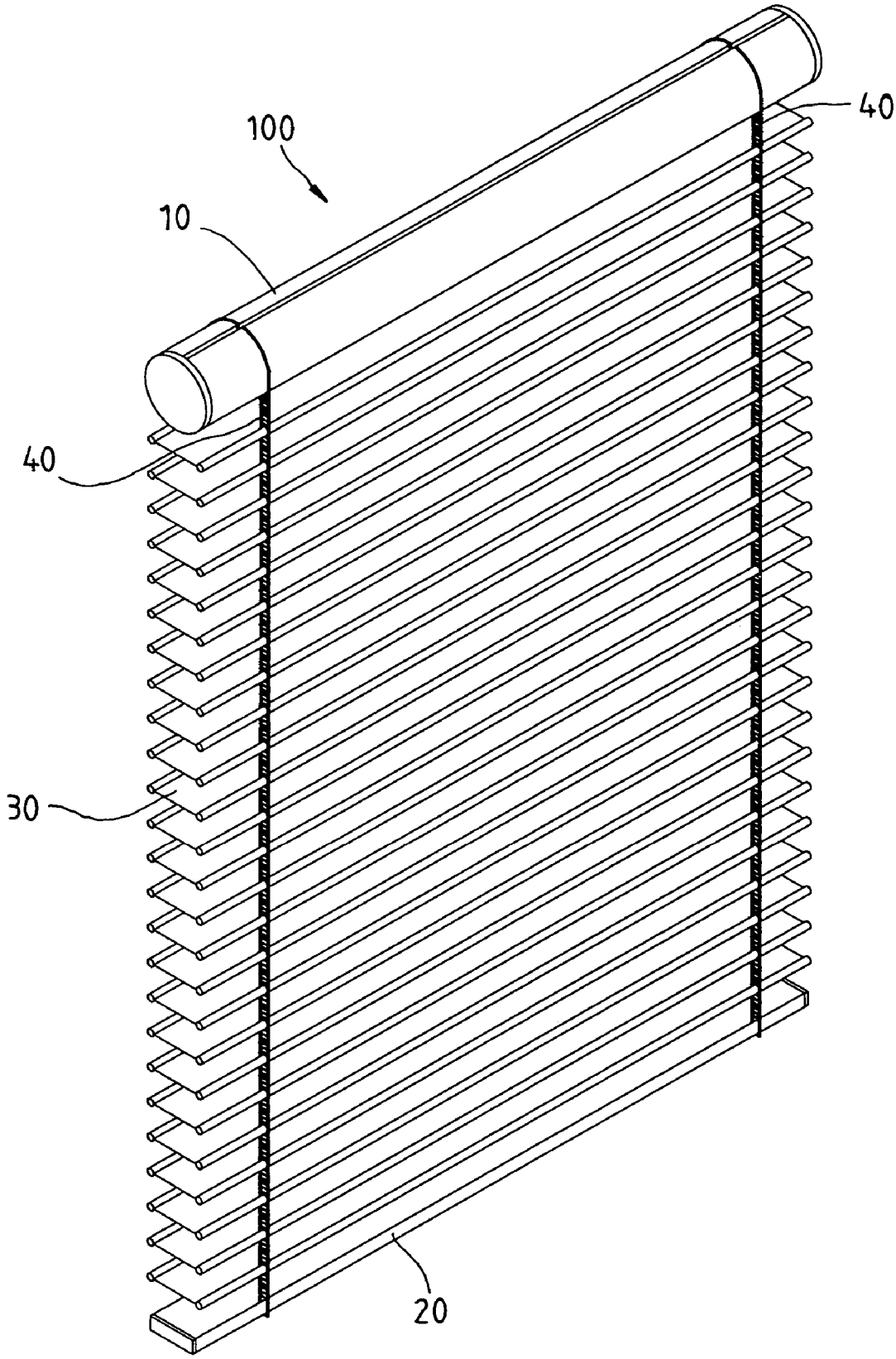
FIG. 1 is a perspective view of a window blind according to the present invention.
Figure 2:
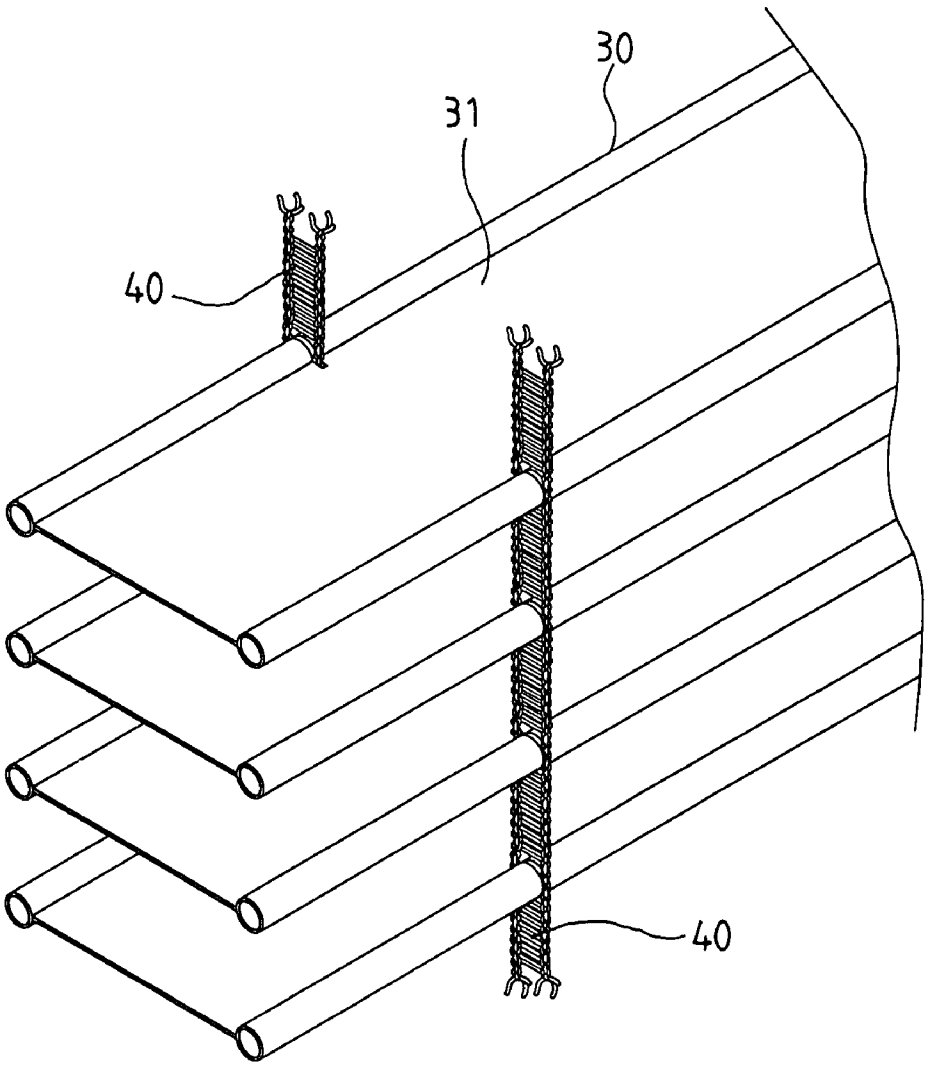
FIG. 2 is an enlarged view of a part of the window blind shown in FIG. 1.
Figure 3:
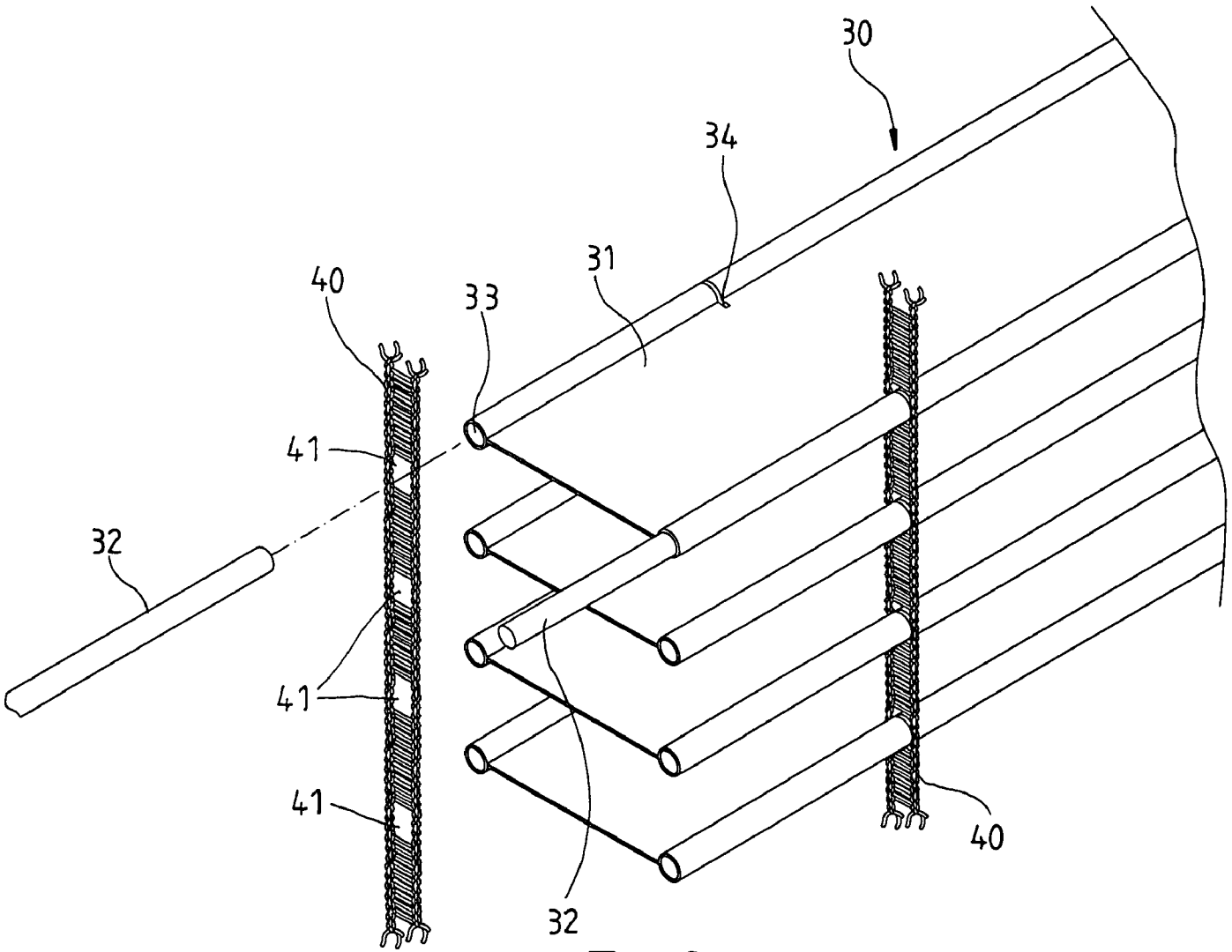
FIG. 3 is an exploded view of a part of the window blind shown in FIG. 1.

Referring to FIGS. 1–3, a window blind 100 in accordance with the present invention is shown comprised of a headrail 10, a bottom rail 20, a plurality of fabric slats 30, and four ladder tapes 40.

The bottom rail 20 is horizontally spaced below the headrail 10.

The fabric slats 30 are made of opaque or semitransparent fabric that provides a predetermined light shading effect, and horizontally arranged at different elevations at an equal pitch between the headrail 10 and the bottom rail 20. Each fabric slat 30 comprises a narrow, elongated, rectangular fabric slat body 31 and two support rods 32. The fabric slat body 31 has two pockets 33 longitudinally extended along the two opposite long sides thereof. Each pocket 33 has two transversely extended crevices 34. The support rods 32 are stiff rod members having an outer diameter slightly smaller than the inner diameter of the pockets 33 and a length approximately equal to the length of the pockets 33. Therefore, the pockets 33 can accommodate the rod members 32, as shown in FIG. 3.

The ladder tapes 40 are arranged into two symmetrical pairs and vertically set at the two opposite long sides of each fabric slat 30 corresponding to the crevices 34, each having one end, namely, the top end fixedly fastened to the headrail 10, and the other end, namely, the bottom end fixedly fastened to the bottom rail 20. The ladder tapes 40 each have a plurality of through holes 41 vertically spaced at an equal pitch. The ladder tapes 40 are respectively engaged into the crevices 34 of the longitudinal pockets 33 of the fabric slats 30, and then the respective rod members 32 are respectively inserted into the longitudinal pockets 33 of the respective fabric slats 30 and the through holes 41 of the respective ladder tapes 40 to join the fabric slats 30 to the ladder tapes 40, keeping the fabric slats 30 vertically spaced at an equal pitch and horizontally arranged in parallel between the headrail 10 and the bottom rail 20 (see FIGS. 2 and 3).

Figure 4:
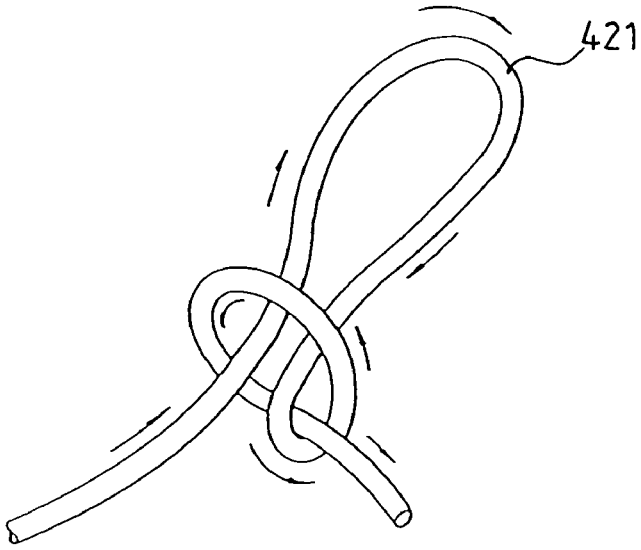
FIG. 4 illustrates the rope weaving procedure of the present invention where a hitch is formed at the first strand.
Figure 5:
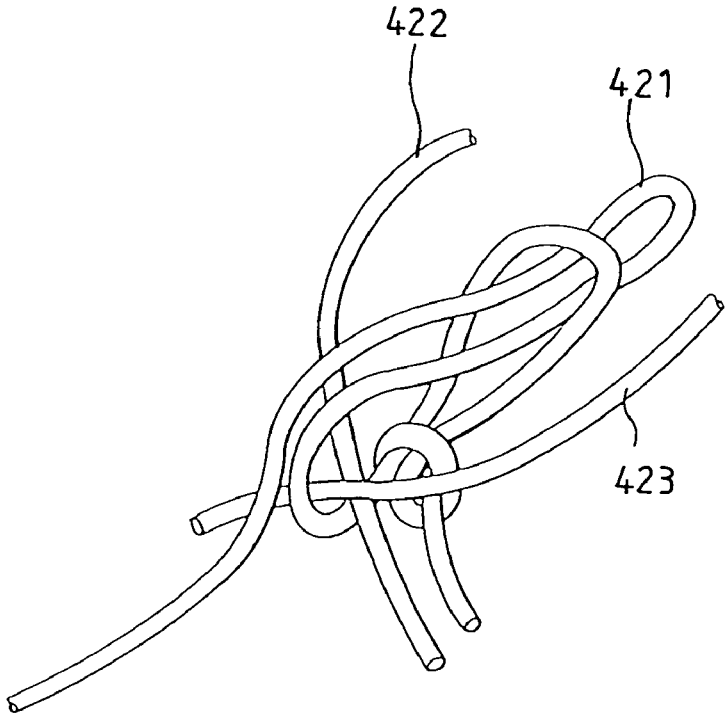
FIG. 5 illustrates the rope weaving procedure of the present invention where the second strand and the third strand are crossed over each other at the first strand, and the first strand is fastening to the crossed second strand and third strand.
Figure 6:
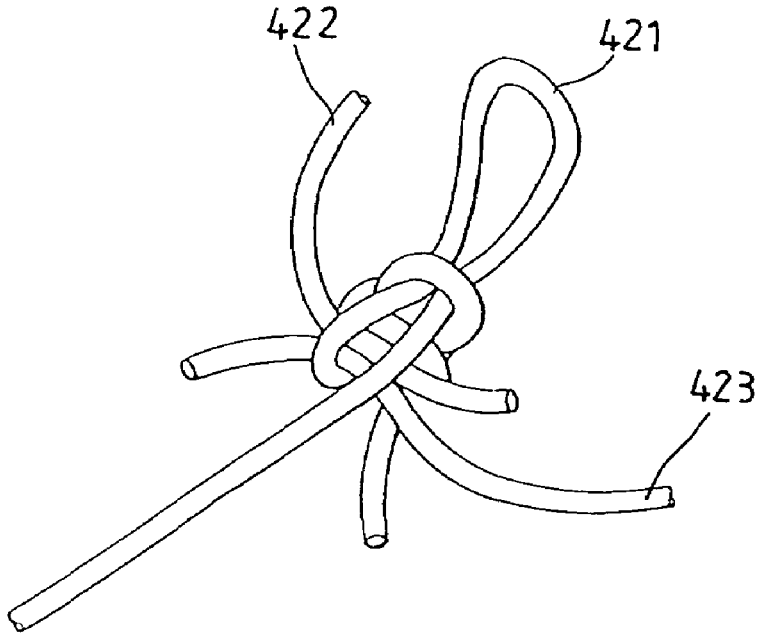
FIG. 6 illustrates the rope weaving procedure of the present invention where the first strand has tied up the crossed second strand and third strand.
Figure 7:
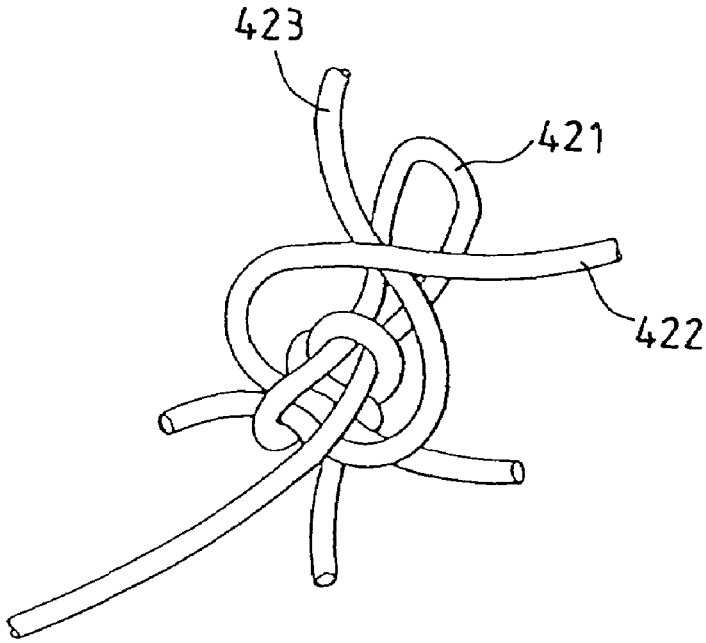
FIG. 7 illustrates the rope weaving procedure of the present invention where second strand and the third strand are crossed over each other again.
Figure 8:
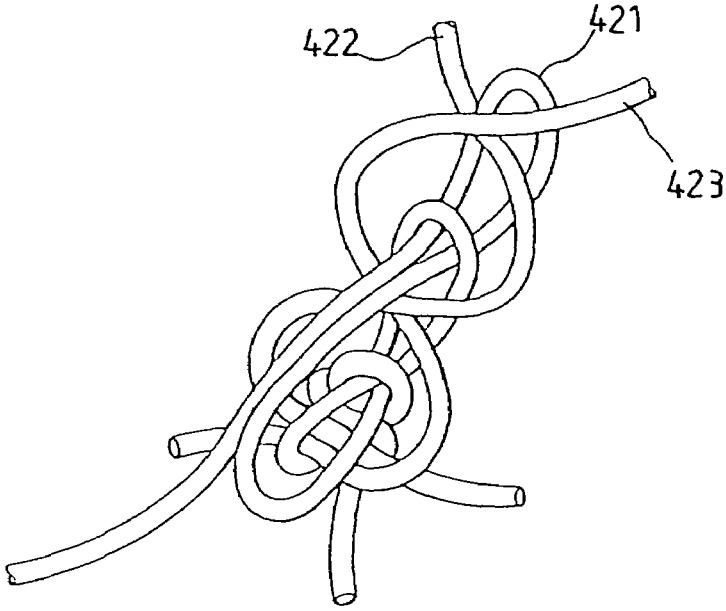
FIG. 8 illustrates the rope weaving procedure of the present invention where the first strand tied up the second strand and the third strand; the second strand and the third strand are crossed over each other at the first strand again.
Figure 10:
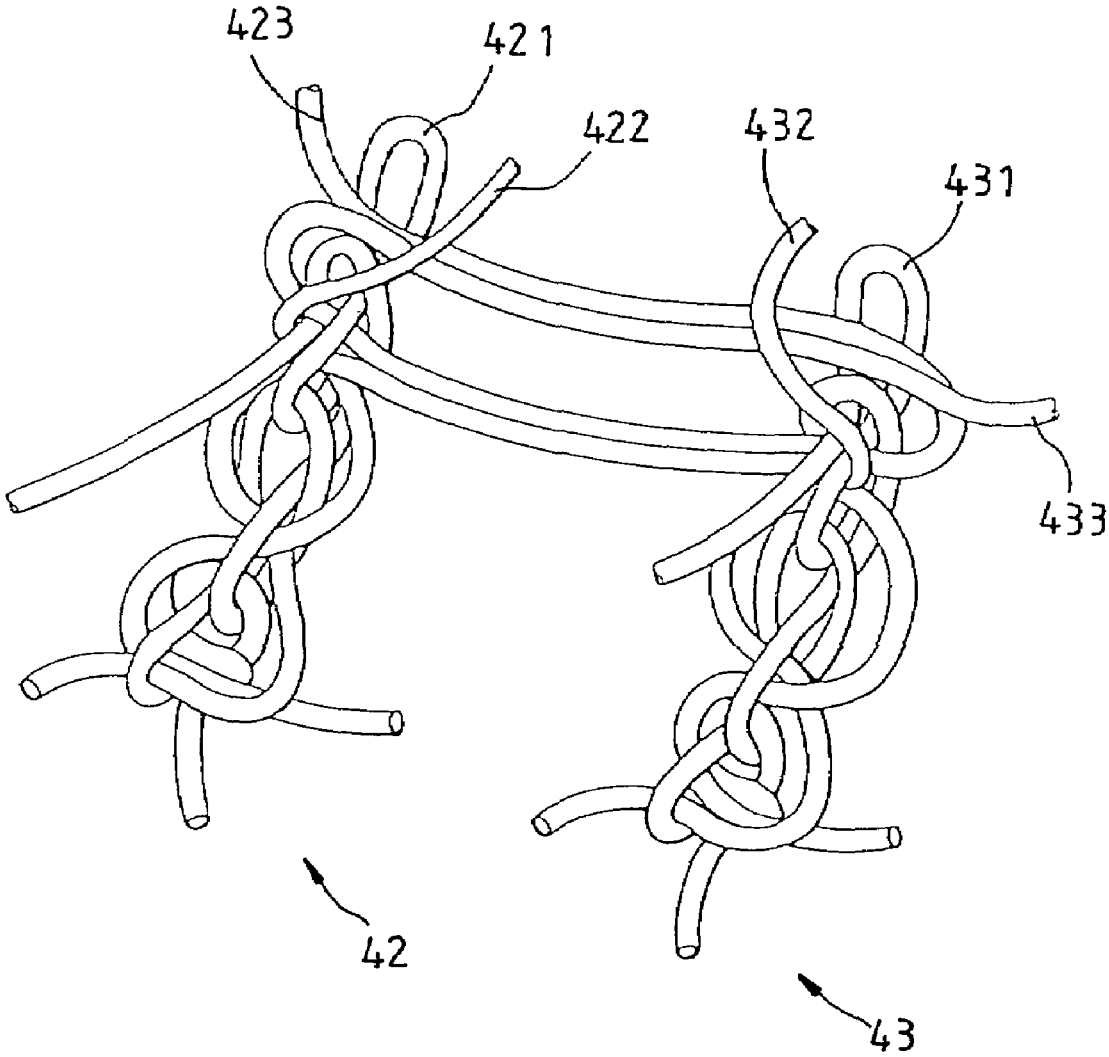
FIG. 10 illustrates secondary interlinking between the first longitudinal rope and the second longitudinal rope during the rope weaving procedure of the present invention.
Figure 11:
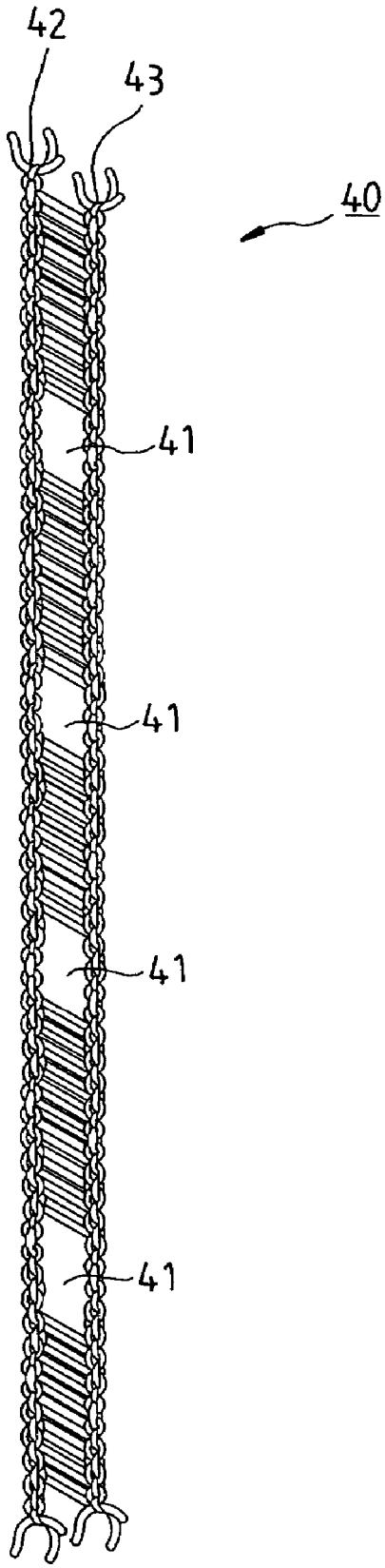
FIG. 11 is a perspective view showing one ladder tape finished according to the present invention.

As shown in FIG. 11, each ladder tape 40 is comprised of a first longitudinal rope 42 and a second longitudinal rope 43. The ropes 42, 43 are arranged in parallel and respectively formed of three strands, forming the aforesaid through holes 41. The first longitudinal rope 42 is formed of a first strand 421, a second strand 422, and a third strand 423. The second longitudinal rope 43 is formed of a fourth strand 431, a fifth strand 432, and a sixth strand 433. The two ropes 42, 43 are woven in the same manner. The weaving of the first longitudinal rope 42 is described hereinafter with reference to FIGS. 4–10 for understanding. At first, make one end of the first strand 421 into a hitch as shown in FIG. 4, and then continuously make the first strand 421 into hitches that insert one into another. During the formation of one hitch, the first strand 421, the second strand 422 and the third strand 423 are crossed over each other, keeping the crossed point between the second strand 422 and the third strand 423 closely attached to the first strand 421 such that the hitch thus formed can simultaneously tie up the crossed status of the second strand 422 and the third strand 423, as shown in FIGS. 5 and 6. Thereafter, the second strand 422 and the third strand 423 are crossed over each other again and attached to the first strand 421, and then the first strand 421 is used to tie up the crossed status of the first strand 421 and the second strand 422 again. This procedure is repeated again and again to form the first longitudinal rope 42. According to the aforesaid weaving method, the fourth strand 431 is used to make hitches to tie up the continuously crossing fifth strand 432 and sixth strand 433, forming the second longitudinal rope 43.

Figure 9:
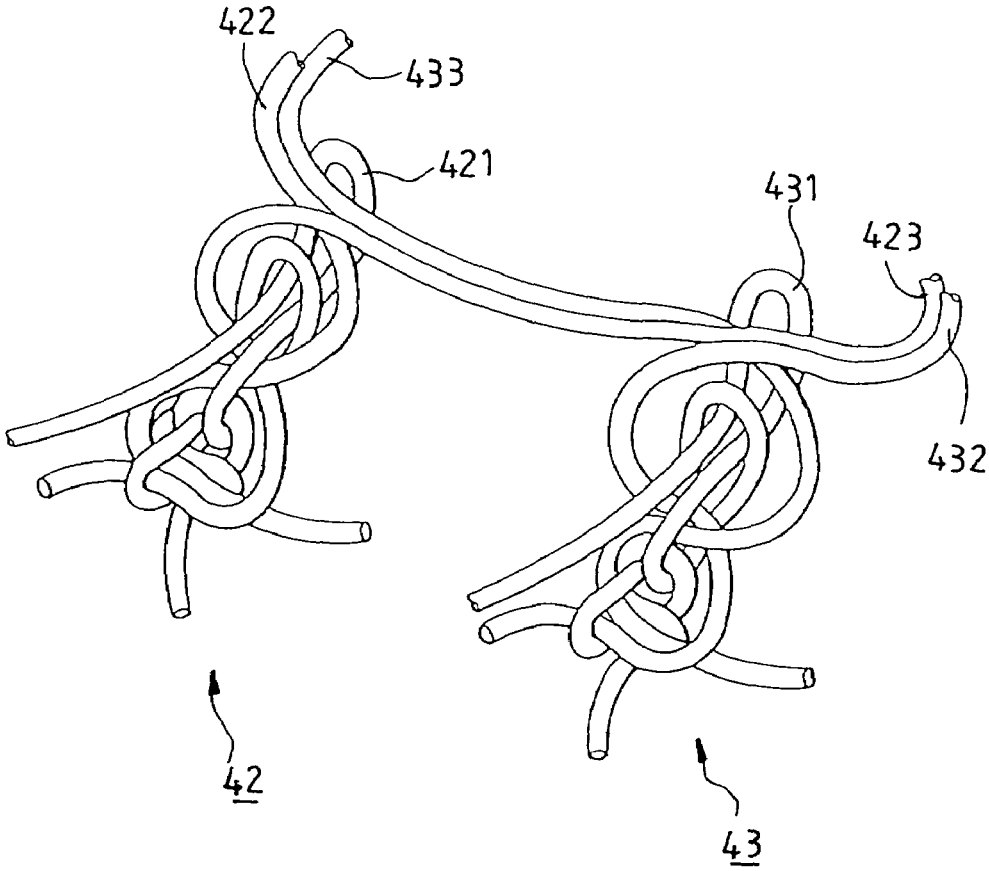
FIG. 9 illustrates interlinking between the first longitudinal rope and the second longitudinal rope during the rope weaving procedure of the present invention.

When making the two longitudinal ropes 42, 43 to form one ladder tape 40, the two longitudinal ropes 42, 43 must be transversely linked. As shown in FIGS. 9 and 10, during weaving of the first longitudinal rope 42, the third strand 423 is pulled sideways toward the second longitudinal rope 43 and crossed over the fifth strand 432 and attached with the fifth strand 432 to the fourth strand 431, and then the fourth strand 431 is used to tie up the crossed status of the third strand 423 and the fifth strand 432, and at the same time, the sixth strand 433 of the second longitudinal rope 43 is pulled sideways toward the first longitudinal rope 42 and crossed over the second strand 422 and attached with the second strand 422 to the first strand 421, and then the first strand 421 is used to tie up the crossed status of the second strand 422 and the sixth strand 433. This cross weaving procedure is repeated again and again, leaving predetermined areas in blank without weaving to form the desired through holes 41. Therefore, the two longitudinal ropes 42, 43 are woven into the desired ladder tape 40 having the desired through holes 41 as shown in FIG. 11.

As indicated above, the ladder tapes are respectively formed of two longitudinal ropes by weaving. Therefore, a weaving machine can be used to fabricate the ladder tapes rapidly, lowering the manufacturing cost. This weaving design enables the ladder tapes to bear a high pull force in longitudinal direction, and the through holes have certain stiffness for easy insertion of the support rods. The aforesaid weaving method is simply an example of the present invention but not a limitation. Other kinds of knots, bends, slices, etc., may be employed to make strands into two longitudinal ropes, and at least one strand of one longitudinal rope is extended sideways and linked to the other longitudinal rope, and blank areas are left for the desired through holes during weaving.

Further, the ladder tapes are shaped like a flat belt. The spirit of the present invention is the formation of equally spaced through holes in flat tapes. By means of the support of the two stiff longitudinal ropes and the support of the strands around the through holes, the through holes of the ladder tapes are kept open for easy insertion of the support rods. According to the aforesaid preferred embodiment of the present invention, the through holes are formed in the ladder tapes by weaving. Alternatively, stiff through holes can be formed in the ladder tapes by any of a variety of conventional methods.

What is claimed is:

1. A window blind comprising:

a headrail;

a bottom rail spaced below said headrail;

a plurality of fabric slats arranged between said headrail and said bottom rail, said fabric slats each having two stiff support rods respectively disposed at two opposite long sides thereof; and a plurality of ladder tapes connected between said headrail and said bottom rail and located respectively at the two opposite long sides of each said fabric slat, said ladder tapes each formed of a plurality of strands by weaving and having a plurality of through holes for the insertion of the support rods of said fabric slats to join said fabric slats to said ladder tapes between said headrail and said bottom rail, wherein the strands of each ladder tape form two longitudinal ropes, the two longitudinal ropes of each said ladder tape having at least one strand extended sideways from one longitudinal rope and linked to the strands of the other longitudinal rope.

2. A window blind comprising:

a headrail;

a bottom rail spaced below said headrail;

a plurality of fabric slats arranged between said headrail and said bottom rail, said fabric slats each having two stiff support rods respectively disposed at two opposite long sides thereof; and a plurality of ladder tapes connected between said headrail and said bottom rail and located respectively at the two opposite long sides of each said fabric slat, said ladder tapes each formed of a plurality of strands by weaving and having a plurality of through holes for the insertion of the support rods of said fabric slats to join said fabric slats to said ladder tapes between said headrail and said bottom rail, wherein said fabric slats each comprise two pockets respectively extended along the two opposite long sides thereof for accommodating the respective support rods, each said pocket having crevices for the ladder tapes.

3. The window blind as claimed in claim 2, wherein said ladder tapes are respectively engaged into the crevices of said fabric slats, keeping the through holes of said ladder tapes in said crevices such that the support rod is insertable into the pocket of the fabric slat and the through hole of the ladder tape.

4. A window blind comprising:

a headrail;

a bottom rail spaced below said headrail;

a plurality of fabric slats arranged between said headrail and said bottom rail, said fabric slats each having two stiff support rods respectively disposed at two opposite long sides thereof; and a plurality of ladder tapes connected between said headrail and said bottom rail and located respectively at the two opposite long sides of each said fabric slat, said ladder tapes each formed of a belt having a plurality of through holes for the insertion of the support rods of said fabric slats to join said fabric slats to said ladder tapes between said headrail and said bottom rail, and two stiff long sides supporting said through holes in shape, wherein said ladder tapes each are comprised of two longitudinal ropes, said longitudinal ropes each being formed of a plurality of stands fastened to one another, the two longitudinal ropes of each said ladder tape having at least one strand extended sideways from one longitudinal rope and linked to the strands of the other longitudinal rope.

5. A window blind comprising:

a headrail;

a bottom rail spaced below said headrail;

a plurality of fabric slats arranged between said headrail and said bottom rail, said fabric slats each having two stiff support rods respectively disposed at two opposite long sides thereof; and a plurality of ladder tapes connected between said headrail and said bottom rail and located respectively at the two opposite long sides of each said fabric slat, said ladder tapes each formed of a belt having a plurality of through holes for the insertion of the support rods of said fabric slats to join said fabric slats to said ladder tapes between said headrail and said bottom rail, and two stiff long sides supporting said through holes in shape, wherein said fabric slats each comprise two pockets respectively extended along the two opposite long sides thereof for accommodating the respective support rods, each said pocket having crevices for the ladder tapes.

6. The window blind as claimed in claim 5, wherein said ladder tapes are respectively engaged into the crevices of said fabric slats, keeping the through holes of said ladder tapes in said crevices such that the support rod is insertable into the pocket of the fabric slat and the through hole of the ladder tape.

* * * * *